US005265288A

United States Patent [19]

Allison

[11] Patent Number: 5,265,288

[45] Date of Patent: Nov. 30, 1993

[54] AUTOMATIC EMERGENCY SPRAY MEANS

[76] Inventor: Gary Allison, 653 Middlegate Rd., Henderson, Nev. 89015

[21] Appl. No.: 929,429

[22] Filed: Aug. 14, 1992

Related U.S. Application Data

[63] Continuation-in-part of Ser. No. 637,663, Jul. 7, 1991, abandoned.

[51] Int. Cl.[5] ..... A61H 33/00

[52] U.S. Cl. ..... 4/620; 4/623

[58] Field of Search ..... 4/620, 621, 622, 623

[56] References Cited

U.S. PATENT DOCUMENTS

| | | | |
|---|---|---|---|
| 3,585,653 | 6/1971 | Forbes et al. | 4/623 |
| 3,809,315 | 5/1974 | Wright | 4/620 |
| 4,084,270 | 4/1978 | Kersten, Jr. | 4/620 |
| 4,823,414 | 4/1989 | Piersimoni et al. | 4/623 |
| 4,839,039 | 6/1989 | Parsons et al. | 4/623 |
| 4,998,673 | 3/1991 | Pilolla | 4/623 |
| 5,060,323 | 10/1991 | Shaw | 4/623 |

FOREIGN PATENT DOCUMENTS

| | | | |
|---|---|---|---|
| 2513737 | 10/1975 | Fed. Rep. of Germany | 4/623 |
| 2918617 | 11/1980 | Fed. Rep. of Germany | 4/623 |

*Primary Examiner*—Henry J. Recla
*Assistant Examiner*—David J. Walczak
*Attorney, Agent, or Firm*—I. Louis Wolk

[57] ABSTRACT

Emergency eyewash spray device designed to eject an upward spray to engage the eyes to an affected individual in response to an electronic sensing device which is positioned to be activated at a distance ahead of the device in order to automatically open an electrically controlled valve to cause water to flow through said spray means prior to the entry of an affected body within the sensing zone in order to accelerate emergency action. Provision is made for simultaneous activation of an alarm signal. The sensing device is positioned and designed to provide activation of the valve at a sufficient distance ahead of the spray means to ensure the availability of the spray to an affected individual who may be rushing to the device.

5 Claims, 1 Drawing Sheet

FIG. 1
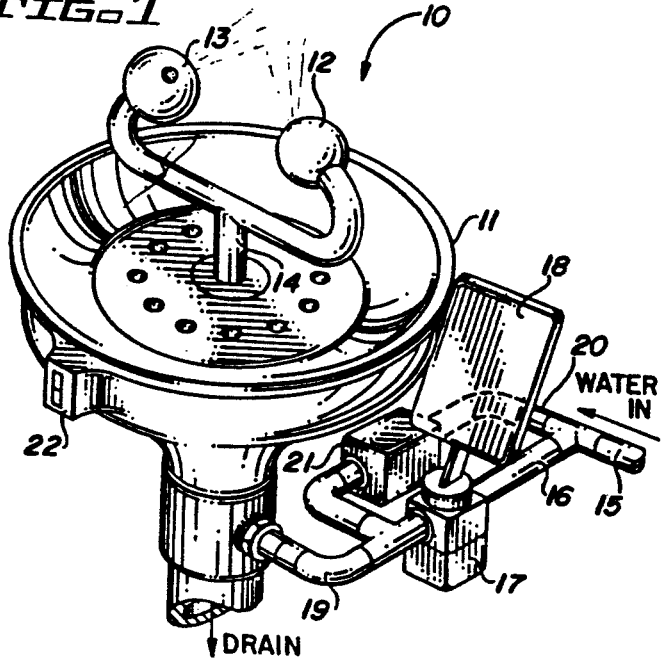
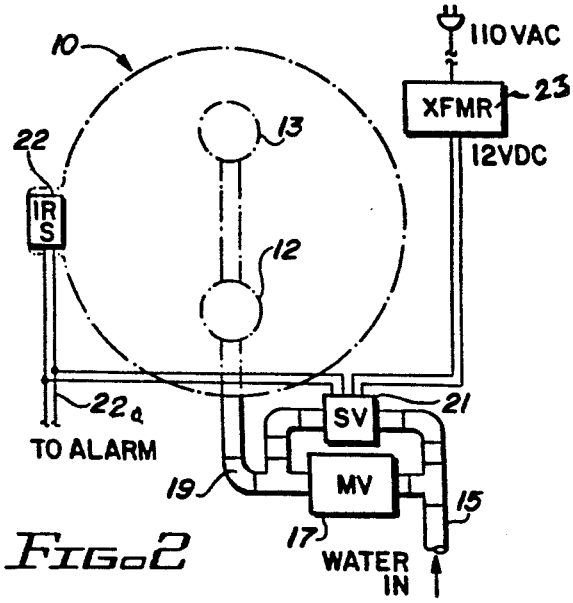
FIG. 2
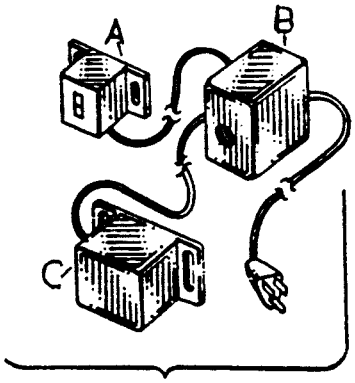
FIG. 3
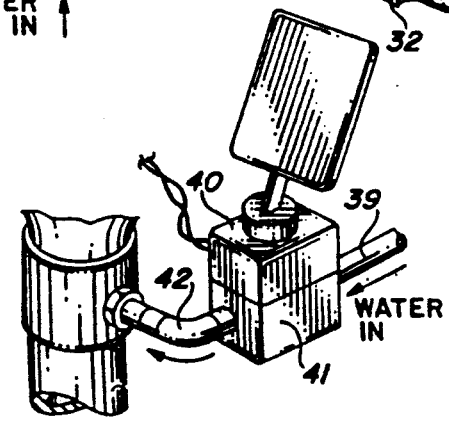
FIG. 5
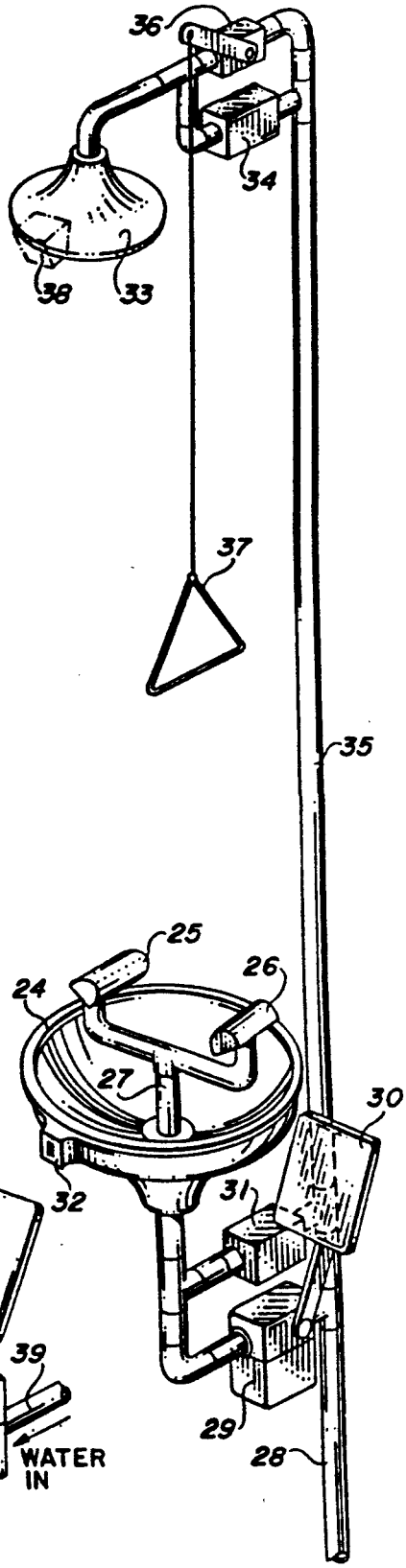
FIG. 4

AUTOMATIC EMERGENCY SPRAY MEANS

BACKGROUND OF THE INVENTION

This application is a continuation-in-part of copending application Ser. No. 637,663, filed Jan. 7, 1991, now abandoned.

This invention relates to emergency fountains and spray devices which are attached to water supply means in order to provide emergency washing means such as eyewash fountains, showers and the like.

Such emergency equipment particularly in the case of eyewash fountains are required for employee safety in laboratories, factories, warehouses, etc. when employees are exposed to irritating and/or corrosive materials. For example, eyewash fountains are will known and have been in use for many years, as shown by U.S. Pat. Nos. 3,925,829, 3,549,251 as well as by applicant's U.S. Pat. No. 4,688,276 and others. These devices generally include upwardly ejecting spray members which are activated by valve means which are turned on either manually of by foot pedals of other physical means.

The one problem with such devices has been that the injured victim must rush to the fountain and manually engage a valve or similar means to cause the spray or fountain stream to be initiated. In cases where such injuries occur, even a fraction of a second may be of critical importance in preventing or minimizing serious injury. The injury which may be blinding or the related shock, is often such as to cause the victim to be unable to quickly locate or operate the manual control. This requires instant automatic availability of the eyewash spray.

SUMMARY OF THE INVENTION

This invention provides instant and automatic operation of an upwardly directed emergency eyewash spray by incorporating electronic sensing means positioned in such manner that it is activated a soon as an affected body enters a given zone of activation in advance of the emergency device so that the spray means or the like comes into operation instantaneously before the affected party and the injured body member must come in contact with the washing liquid in the upwardly directed spray of the eyewash device. This ensures the availability of the spray immediately with no concern about locating a valve mechanism.

This is accomplished by providing a electronic sensing zone in advance of and spaced from the spray means in a position so that the entry of an injured person into a given sensing area will cause the opening of an electronically controlled valve such as a solenoid valve to open and admit water into the spray or fountain devices.

Such sensing means may include photo-electric beam devices, capacitor activated means infra-read beams and similar electronic beam of wave responsive devices which can activate an electronically controlled valve such as a solenoid valve. Such means may be mounted upon or adjacent to the eyewash device.

This means that an injured party can immediately rush toward the device and be assured of instantaneous treatment at the moment of his contract with the already activated stream. This is especially important where the individual may be fully or partially blinded and need not to lose time by feeling his way or fumbling for the control valve. Even where the party is incapacitated, activation can occur by leading or shoving the individual toward the emergency device into the sensing zone. This type of "no-hands" operation has been found to be of great value in emergency situations. The utility of the electronic sensing device is greatly enhanced by the fact that the area and scope of the sensing zone may be regulated to provide a greater or lesser advance activation area.

In addition, manually operated valve means may be provided as an alternate or as a safety back-up means.

The design of the sensing means and the area or scope of the zone of activation must be such that the spray means will be fully activated before the user actually reaches the emergency device. As a practical matter this means within a radius of about 2–5 feet from the device, or more.

THE PRIOR ART

Certain of the prior art cited in the above mentioned parent application, Ser. No. 637,663 describes automatic activation of faucets or conventional types of shower heads. For example U.S. Pat. Nos. 5,060,323, 3,585,653, 4,839,039, and German Patent 2,918,617 all show various means for controlling water flow through was basin faucets operable by sensors which are activated by the presence of the users. In none of these patents is the emergency concept of the present invention especially adapted for eyewash devices using an upwardly directed spray taught. Even though the use of sensors for flow control has been known for many years, applicant is the first to conceive and successfully apply this principle to emergency eyewash devices.

BRIEF DESCRIPTION OF THE DRAWINGS

In the drawings:

FIG. 1 is an isometric view in perspective of an eyewash device incorporating an electronic sensing device projecting a photoelectric beam mounted in front thereof showing an electrically controlled solenoid valve and an optional manual valve.

FIG. 2 is a top plan view of the device of FIG. 1 in dotted lines showing in addition the electric wiring referred to.

FIG. 3 shows an isometric view of the units of a retrofit kit useful in adapting existing manually operated devices.

FIG. 4 describes in perspective an isometric view of a combination of the device of FIG. 1 with an overhead spray or shower.

FIG. 5 describes in outline a valve arrangement for use in the device of FIG. 1 in which a combination electronic-manual valve may be utilized instead of separate valves.

DESCRIPTION OF PREFERRED EMBODIMENTS

Referring now to the drawing, in which FIG. 1 shows an eyewash assembly 10 incorporating the present invention. This includes a bowl 11 eye spray means 12 and 13 fed by pipe 14 with water entering through pipe 15. Pipe 16 feeds water through a manual valve 17 which may be controlled by an emergency paddle 18 thence through pipe 19 to spray supply pipe 14. An electronically responsive valve 21 is connected to water supply pipe 20 and is activated by an electronic sensing device, i.e., a photo-electric beam cell 22 mounted in front of the bowl with its beam focused forwardly of the bowl in order to permit activation by interruption of the beam with resultant opening of the electronic valve 21 and generation of an upward spray though nozzles 12 and 13 almost instantaneously upon body contact with the beam and resultant automatic eyewash effectiveness when the affected person places his head or other parts of his body in contact with the water spray without the necessity of fumbling for a valve control or even having to think about doing so.

FIG. 2 illustrates the arrangement shown on FIG. 1, partly in outline, a top plan view in which 12 volt D.C. current is supplied from a 110 volt A.C. line though transformer-rectifier 23 to energize the circuit from sensor 22 to activate electronic valve 21 admitting water though pipe 15 valve 21 and pipe 19 to spray nozzles 12 and 13. An alarm circuit 22*a* may be provided in which an alarm, audible or visual, may be simultaneously activated the instant the sensor is activated to alert appropriate emergency personnel.

FIG. 3 illustrates a retrofit kit which may be used to adapt an existing spray installation to perform as described herein. This includes a sensor A, a solenoid valve B, and a 12 volt D.C. transformer C. These can be incorporated in an existing installation which uses a manual valve in a manner obvious to a skilled plumber or mechanic.

The sensor referred to may be of any type suitable for activating an electronic valve of the type referred to, for example, the sensor may be a solid state photo-electric proximity sensor of the infra-red type having an adjustable distance scan such as Banner Electric FM 500 series, or the like.

As shown in FIG. 4, the eyewash apparatus of FIG. 1, or the like, may be combined with an overhead shower which can be activated simultaneously with the eyewash or separately or if desire, only manually. The shower my be over the eyewash or space therefrom or even entirely separate. As shown, bowl 24 supports nozzles 25 and 26 supplied by pipe 27, fed from a water source through pipe 28, thence through manual valve 29, optionally operated by paddle 30, or normally through electronic valve 31 activated by photo-electric sensor 32, thus causing water to flow through pipe 27 to the spray nozzles as described. The showerhead may be activated simultaneously by a separate electronic valve 34 connected to sensor 32 with water flowing through pipe 35 or manually through valve 36 operated by a grasping pull member 37. If desire, the shower spray may be independently operated through electronic sensor 38 which may be positioned on the showerhead focused downward or at a point on the supply pipe 35 at body level focused forward.

As shown on FIG. 5., a combination electronic valve and manual valve may be operatively mounted on the same water supply line. Water supply line 39 feeds to a manual valve 40 operated by a push paddle and a separate valve mechanism in the line operated by solenoid valve 41 activated by a sensor mounted as shown on FIG. 1. Water flow as governed by either of these valve flows through pipe 42 to spray means (not shown), which may be supported over a bowl as in FIG. 1, or to a showerhead or combination of shower and eye spray as described above.

While the electronic sensing means has been illustrated and described above as positioned on the washing device itself, such means may be placed in any desired separate location such as above, i.e., ceiling, below, i.e., floor, or laterally spaced therefrom, and connected to the electrically, controlled supply valve. The objective is to insure activation by the present or proximity of the user in advance of the spray means itself to permit advance generation of the desired spray. For example, an infra-red or the like beam may be focused across the front of the device so that when interrupted, the supply valve will open, etc.

I claim:

1. An emergency eyewash device adapted to automatically direct an upward spray of water upon remote activation thereof by sensing the presence of a user at a distance in advance thereof sufficient to ensure projection of said spray sufficiently in advance of contact therewith by an affected individual which comprises a spray means comprised of a spaced pair of nozzles positioned over a bowl which serves as a receptacle for water distributed by said nozzles, said nozzles being positioned and designed to project said spray upward to permit engagement thereof with the eyes of a user, a supply conduit for said water, an electrically controlled valve associated with said supply conduit to control water flow therethrough, and electronic sensing means operatively connected to said electrically control valve, said sensing means being positioned at the front of said bowl and designed to create a sensing zone sufficiently in front of said bowl to permit opening of said electrically controlled valve and generation of said spray upon entry of a body into said sensing zone and prior to contact of said body with said spray, said sensing zone extending over a radius of an area having approximately five or more feet from said sensing means, thereby assuring automatic advance operation of said spray within the time period required for the user to travel from entry into said sensing zone to reach said spray.

2. An emergency eyewash device according to claim 1, wherein an alarm signal is provided as an automatic alert, such signal being activated through said sensing means simultaneously with activation of said spray means to provide emergency notification.

3. An emergency eyewash device according to claim 1, wherein elevated spray means is positioned above and adjacent to said eyewash device for the downward projection of a spray in the form of a shower, said spray means being activated by opening of an electrically controlled flow valve responsive to said sensing means.

4. An emergency eyewash device according to claim 1, wherein said water supply conduit means comprises a bypass conduct having a manually controlled valve to permit optional manual control.

5. An emergency eyewash device according to claim 1 wherein a manual valve is separately interposed in the same water supply conduit as the said electrically controlled valve to permit optional manual operation.

* * * * *